US010052543B1

(12) United States Patent
Steele et al.

(10) Patent No.: US 10,052,543 B1
(45) Date of Patent: Aug. 21, 2018

(54) SPORTS EQUIPMENT SWING TRAINING AID INCORPORATING A REVERSIBLE THERMOCHROMATIC LEUCO DYE FOR PROVIDING A TEMPORARY VISUAL SWING-RELATED FEEDBACK TO A USER AND A METHOD OF USE

(71) Applicants: Raymond Steele, Deerfield Beach, FL (US); Sherry Deanna Richardson, Deerfield Beach, FL (US)

(72) Inventors: Raymond Steele, Deerfield Beach, FL (US); Sherry Deanna Richardson, Deerfield Beach, FL (US)

( * ) Notice: Subject to any disclaimer, the term of this patent is extended or adjusted under 35 U.S.C. 154(b) by 0 days.

(21) Appl. No.: 14/607,817

(22) Filed: Jan. 28, 2015

Related U.S. Application Data

(63) Continuation-in-part of application No. 14/223,675, filed on Mar. 24, 2014.

(51) Int. Cl.
*A63B 69/36* (2006.01)
*A63B 71/06* (2006.01)

(52) U.S. Cl.
CPC ..... *A63B 69/3661* (2013.01); *A63B 69/3623* (2013.01); *A63B 2071/0694* (2013.01)

(58) Field of Classification Search
USPC ..... 473/219, 226, 227, 228, 229, 230, 242, 473/257, 278
See application file for complete search history.

(56) References Cited

U.S. PATENT DOCUMENTS

| | | | | |
|---|---|---|---|---|
| 3,423,096 | A * | 1/1969 | Tone | 473/278 |
| 3,599,982 | A * | 8/1971 | Elesh | 473/278 |
| 4,832,344 | A * | 5/1989 | Werner | 473/244 |
| 4,932,662 | A * | 6/1990 | Blaisdell | 473/237 |
| 5,213,329 | A * | 5/1993 | Okumoto et al. | 473/328 |
| 5,603,665 | A * | 2/1997 | Bryant | 473/230 |
| 6,941,818 | B2 * | 9/2005 | Rakowski | 73/762 |
| 7,896,754 | B1 * | 3/2011 | Winters | 473/226 |
| 2002/0091011 | A1 * | 7/2002 | Sosin | 473/278 |
| 2006/0252568 | A1 * | 11/2006 | Simmons | 473/226 |
| 2012/0231900 | A1 * | 9/2012 | Kilby et al. | 473/387 |

* cited by examiner

*Primary Examiner* — Nini Legesse
(74) *Attorney, Agent, or Firm* — Glenn E. Gold, P.A.; Glenn E. Gold; David Colls

(57) ABSTRACT

A sports mat system incorporating a reversible thermochromic leuco dye includes an impact pad portion having a reversible thermochromic leuco dye incorporated into it in order to provide a temporary visual indication of the path of a sports apparatus swing. The impact portion changes color with a temperature change due to frictional contact between the pad and the equipment being swung, in order to visually illustrate the swing path of the club along with the club head/face orientation during impact. In another implementation, a racquet is provided incorporating a reversible thermochromic leuco dye into a portion of racquet strings to temporarily visually illustrate the contact area between the racquet face and a ball being struck, in order to provide the user with feedback relating to characteristics of their swing.

13 Claims, 8 Drawing Sheets

SPORTS EQUIPMENT SWING TRAINING AID INCORPORATING A REVERSIBLE THERMOCHROMATIC LEUCO DYE FOR PROVIDING A TEMPORARY VISUAL SWING-RELATED FEEDBACK TO A USER AND A METHOD OF USE

CROSS-REFERENCE TO RELATED APPLICATIONS

This U.S. non-provisional patent application is a continuation-in-part of, and claims the benefit of, co-pending U.S. non-provisional patent application Ser. No. 14/223,675, filed on Mar. 24, 2014, by the same inventors, the entire contents of which is incorporated by reference herein.

FIELD OF THE INVENTION

The present invention relates generally to sports equipment swing training aids, such as golf club swing training mats. More specifically, the invention pertains to such training aids incorporating thermochromic dyes, and their methods of use for providing an accurate temporary visual indication to a user of important swing variables, such as swing direction and the angle/orientation of the contact portion of the sports equipment (e.g., golf club, hockey stick and tennis racket) at the moment of impact with the respective object being contacted (e.g., a golf ball, hockey puck and tennis ball).

BACKGROUND OF THE INVENTION

Sports training aids are a multi-billion dollar market worldwide. Many such aids are specifically geared toward aiding individuals in sports involving the swinging of sporting equipment, such as golf clubs, hockey sticks and tennis rackets, while contacting respective objects, such as a golf ball, a hockey puck/ball and a tennis ball. A major limitation of many existing aids is that while they may provide an indication to the user that something about their swing is wrong, they don't provide an immediate indication to the user of what specific characteristic of their swing is causing the problem. Sports mats are popular as training aids for various sporting activities. For instance, golf mats are commonly used by golf enthusiasts to hit golf balls on a driving range, into a golf net, etc. In that case, the golfer may obtain some limited feedback based upon the flight direction/path and trajectory of the golf ball. For instance, a golfer may see that a golf ball was hooked, sliced, had a bad trajectory, wrong distance, etc. However, since there are many factors that contribute to determine the ball flight the user is left guessing as to what swing variable(s) caused the problem. Consequently, absent the assistance of another experienced trainer/teacher, or high tech video equipment, the individual is left to the very imperfect science of trial and error. Accordingly, many such existing training aids make it very difficult, if not impossible, for individuals to self-diagnose their swing.

In order to perfect one's swing, an individual will often hire a trainer or coach to assist in diagnosing or analyzing the players swing. This can involve direct observation of the player by the trainer and/or sometime videotaping the swing for later reference and analysis. Both of these are useful to a player but costly and require repeated visits to the trainer.

Thus, there exists a need for a personal training device which enables a player to receive immediate feedback on the nature of the swing while practicing in the comfort of their own home, without requiring the high cost of a human trainer and/or expensive video/electronic equipment. More particularly, there exists a need for a practice aid, such as a practice mat for sports involving the contact of an object off of a ground surface, or a practice racket for sports involving contacting an object during flight above a ground surface, which provides immediate visual feedback to the user with regard to important swing variables. Furthermore, it would be beneficial to provide such an aid that provides a temporary non-permanent visual indication, such that the aid can be used repeatedly. In the case of sports involving ground-struck objects, it would be advantageous for the practice mat to provide an immediate visual display of the entire contact surface area made between the equipment and the mat during the swing, which immediately visually conveys important swing characteristics to the user (e.g., the angle of a golf club face or hockey stick blade at impact and the swing direction through impact). In the case of racket-related sports, such as tennis, racquetball, badminton, etc., it would be equally advantageous to provide such a temporary visual indication of characteristics relating to the location of impact on the racquet strings vis-à-vis the racquet face, and the position/orientation of the racquet face at impact.

These and other aspects, features, and advantages of the present invention will become more readily apparent from the attached drawings and the detailed description of the preferred embodiments, which follow.

SUMMARY OF THE INVENTION

In one implementation, a sports practice aid for providing visible feedback relating to characteristics of the user's swing of a handheld piece of sporting equipment while attempting to strike an object with the equipment, comprises:

a strip of a resilient substrate, the strip having a first exposed textured surface and an adhesive layer disposed upon an opposite second substrate surface, wherein the resilient substrate strip is configured and otherwise sized and shaped for being adhesively attached to a surface portion of said handheld piece of sporting equipment;

an impact mat having a topside constructed and configured for supporting the object intended to be struck while swinging said handheld piece of sporting equipment; and a reversible thermochromic leuco dye integrated into an area of said impact mat topside, said reversible thermochromic leuco dye having the characteristic of displaying a visibly noticeable color change with an increase in temperature, wherein, during the process of swinging said sporting equipment while attempting to strike said object while said object is resting upon said impact mat topside, frictional contact between an object contact end of said sporting equipment and said topside of said impact mat increases the temperature of said thermochromic leuco dye such that a resulting color change along said entire contact surface area between the equipment and the upper surface of the impact mat define a temporarily visible contact path made during said swing.

In an aspect, the impact mat may be removably supported within a base constructed and configured for being positioned upon a ground surface and preventing movement of said impact mat during contact between said equipment impact end and said impact mat.

In another aspect, the impact mat occupies about one-quarter to one-half of said base.

In another aspect, the base and the impact pad are generally rectangular.

In another aspect, the impact pad is disposed within a cavity, or depression, provided in the base.

In another aspect, the impact pad further comprises a pad substrate having artificial turf integrated into the pad and extending upward therefrom.

In another aspect, the thermochromatic leuco dye is impregnated into the pad substrate.

In another aspect, the thermochromatic leuco dye is impregnated into the artificial turf.

In another aspect, the thermochromatic leuco dye is chosen such that the temporarily visible contact path disappears within a predetermined period of time.

In another aspect, the thermochromatic leuco dye is chosen such that the temporarily visible contact path disappears within five seconds.

In another aspect, the resilient substrate has a composition including an ultraviolet (UV) radiation protecting component to minimize degradation of the substrate from exposure to sunlight.

In another aspect, the resilient substrate is preferably dimensioned having a length within a range of approximately two (2) inches to four (4) inches, a width within a range of approximately one-half (½) inch to three-quarters (¾) of one inch. Furthermore, the resilient substrate is preferably constructed in a relatively thin adhesive tape form.

In another aspect, a method is provided for performing a swing analysis while swinging a handheld piece of sporting equipment to contact an object resting on a surface, comprising the steps of:

providing an impact mat having a topside constructed and configured for supporting the object intended to be struck while swinging said handheld piece of sporting equipment, a reversible thermochromic leuco dye integrated into an area of said impact mat topside, said reversible thermochromic leuco dye having the characteristic of displaying a visibly noticeable color change with an increase in temperature;

resting said object upon said impact mat topside within the area having said reversible thermochromatic leuco dye integrated therein;

swinging said sporting equipment while attempting to strike said object while said object is resting upon said impact mat topside, frictional contact between an object contact end of said sporting equipment and said topside of said impact mat increasing the temperature of said thermochromic leuco dye such that a resulting color change along said entire contact surface area between the equipment and the upper surface of the impact mat defines a temporarily visible contact path made during said swing; and analyzing said temporarily visible contact path in order to determine characteristics of said swing.

In another aspect, the step of analyzing the temporary visible contact path is useful for deciphering between a toe-up, toe-down or level club angle at impact.

In another implementation, a sports practice aid for providing visible feedback relating to characteristics of the user's swing of a handheld piece of sporting equipment while attempting to strike an object with the equipment, comprises:

a racquet body, including a grip portion and a racquet head;

taut racquet strings woven across said racquet head forming a woven network, said woven network of strings defining an object striking area;

a reversible thermochromic leuco dye integrated into said taut racquet strings of at least a partial area of said woven network, said reversible thermochromic leuco dye having the characteristic of displaying a visibly noticeable color change with an increase in temperature, wherein, during the process of swinging said sporting equipment while attempting to strike said object, frictional contact between the object and the taut racquet strings incorporating said reversible thermochromic leuco dye increases the temperature of said reversible thermochromic leuco dye such that a resulting color change along said entire contact surface area during said swing defines a temporarily visible contact area along said woven network of strings.

In an aspect, the woven string network includes vertical and horizontal string lengths and the reversible thermochromic leuco dye is incorporated into an impact zone defined by a partial area of said area of overlapping vertical and horizontal strings within said racquet head.

In an aspect, the string lengths contained within the impact zone are impregnated with a reversible thermochromic leuco dye.

In an aspect, the string lengths contained within the impact zone are coated with a reversible thermochromic leuco dye.

In another aspect, the reversible thermochromatic leuco dye is chosen such that the temporarily visible contact area disappears within a predetermined period of time.

In another aspect, the reversible thermochromatic leuco dye is chosen such that the temporarily visible contact area disappears within five seconds.

In another aspect, a method is provided for performing a swing analysis while swinging a handheld racquet to contact an object, comprising the steps of:

providing a racquet having a body, including a grip, a racquet head, taut racquet strings woven across said racquet head forming a woven network, said woven network of strings defining an object striking area, a reversible thermochromic leuco dye integrated into said taut racquet strings of at least a partial area of said woven network, said reversible thermochromic leuco dye having the characteristic of displaying a visibly noticeable color change with an increase in temperature;

striking said object with said racquet, wherein, during the process of swinging said sporting equipment while attempting to strike said object, frictional contact between the object and the taut racquet strings incorporating said reversible thermochromic leuco dye increases the temperature of said reversible thermochromic leuco dye such that a resulting color change along said entire contact surface area during said swing defines a temporarily visible contact area along said woven network of strings; and analyzing said temporarily visible contact area in order to determine characteristics of said swing.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF REPRESENTATIVE IMPLEMENTATIONS

Figure 1:
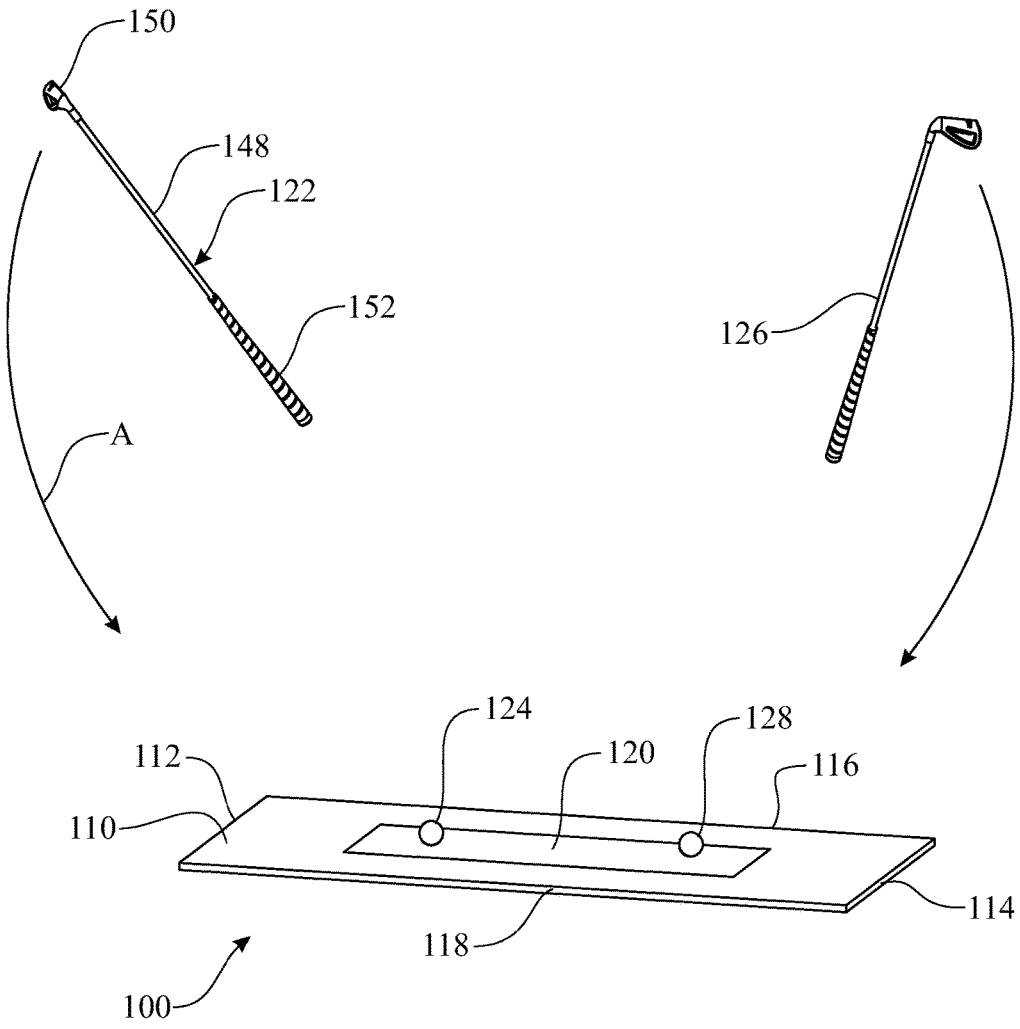
FIG. 1 presents an isometric view of a practice mat having a thermochromic center portion for use by right and left hand golfers.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Thermochromism is the property of substances to change color due to a change in temperature. Thermochromic dyes are based on mixtures of leuco dyes with suitable other chemical, displaying a color change (usually between colorless leuco form and the colored form) in dependence on temperature. The dyes are rarely applied on materials directly; they are usually in the form of microcapsules with the mixture sealed inside. The present invention incorporates a reversible leuco dye, which changes color when heated and when cooled, changes back to a colorless leuco form. Typically, for leuco dyes to change color it takes about 5° F. (3° C.) temperature change. Leuco dye products can be found in a wide variety of forms, including, for example, slurry, powder, water-based ink, epoxy, etc. Thermochromic encapsulated dyes are well known in the art, and have primarily been incorporated into plastic or textile colorants for wide commercial applications. Again, thermochromic dyes undergo a color change over a specific temperature range. The dyes currently available change from a particular color at low temperature to colorless at high temperature (e.g., red at 29.5° C. and colorless at above 32° C.). The color change temperature can be controlled, such that the color change can take place at different temperatures. Thermochromic dye manufacturers are able to manipulate the critical temperature for the color change. As will be apparent to those skilled in the art, where such a dye is integrated with a colored substrate, when the dye is heated it will become colorless such that the color that is visible to an individual will change from the dye color to the color of the base substrate.

The present invention incorporates the well-known reversible thermochromic properties of leuco dyes to provide novel sporting equipment swing practice aids, in order to provide users the ability to more readily self-conduct swing analysis of, for example, a golf club, a hockey stick and a tennis racquet, to name just a few. It should be understood that, although much of the following description and corresponding illustrations refer specifically to golf swing, hockey swing and tennis racquet swing applications of the novel product, these are merely exemplary implementations.

Referring to FIGS. 1-5, and initially with regard to FIG. 1, there is disclosed a golf swing practice mat construction 100 for use as a teaching aid so that a golfer may have immediate visual feedback of the path of his golf swing, as well as the angle/orientation of a golf club face during impact with a golf ball 128. The practice mat 100 may include a base portion 110 having first and second ends, 112 and 114 respectively, and first and second sides, 116 and 118 respectively. Significantly, the practice mat 100 includes an impact area/zone or pad portion 120, which is constructed incorporating a reversible thermochromatic leuco dye, which changes from an original predetermined dye color to clear when heated due to friction between the golf club head/blade 150 and the pad portion 120 as the golf club head/blade 150 is swept across a topside of the pad during a practice golf swing. When the leuco dye becomes clear, it reveals the color of the original substrate into which the leuco dye has been incorporated. The invention contemplates incorporating the reversible thermochromic leuco dye in any manner known in the art, which may include a pad portion substrate 120 (as shown), which changes from an initial color at an ambient temperature to clear upon heating. In this case, the change in color (along the swing contact path between a piece of equipment being swung and the topside of the pad) would temporarily allow the user to decipher the swing contact area. Furthermore, it is contemplated that the area of the upper surface 142 above the impact area of the mat, may incorporate any artificial turf material (e.g., polymer strands) impregnated with a reversible thermochromic leuco dye, such that the strands themselves change from the dye color to the original ambient temperature polymer strand color.

Although it is possible, and contemplated, that the impact pad portion 120 could be utilized without a base, in a preferred implementation of the invention a pad portion is supported by, or within, a base 110. The impact pad preferably occupies a surface area within a range of one-fourth to one-half of the surface area of the base. The reversible thermochromic dye provides an immediate, but temporary, visual representation of the actual line of a golfer's swing, as will be described in more detail below. The practice mat 100 is suitable for use by a right-handed golfer (not shown) swinging a right-hand golf club 122 to hit a golf ball 124 positioned resting upon the impact mat 120, and by a left-handed golfer (not shown) swinging a left-handed golf club 126 to hit a golf ball 128 positioned resting upon the impact mat 120.

In an implementation, the reversible thermochromic leuco dye preferably becomes temporarily clear to display a predetermined more-visible darker color along the contact swath as the club head sweeps against the mat during a golf swing. For example, where the reversible thermochromic leuco dye having a first visible color is impregnated directly into golf mat strands having a second darker color, when the impregnated strands heat up during frictional contact with the club head/face, the leuco dye temporarily takes on a clear characteristic to expose the darker base strand color. Likewise, in another effective implementation where the reversible thermochromic leuco dye having a first visible color is impregnated or otherwise incorporated into an underlying mat substrate (itself covered with artificial turn strands, etc.), when the impregnated mat is heated during frictional contact with the club head/face, the leuco dye temporarily takes on a clear characteristic to expose a darker base impregnated mat color through the overlying turn strands, etc. In either instance, the temporary resulting darker color provides a very clear indication to the user of her club swing path, as well as clubface position and orientation during impact with the golf ball.

Figure 2:
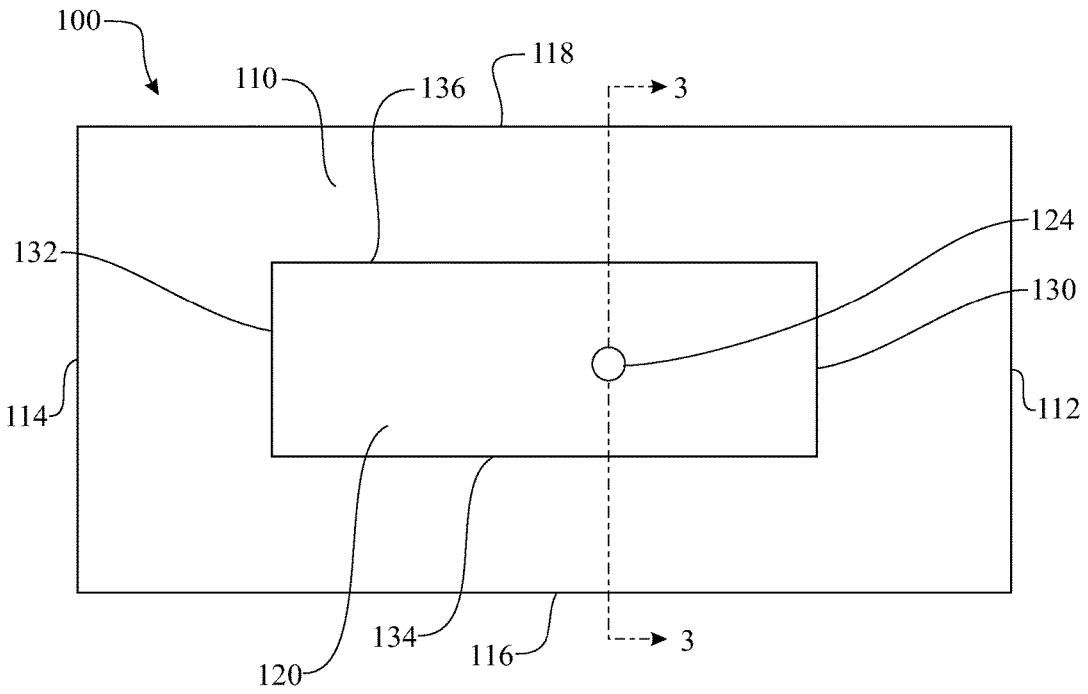
FIG. 2 presents a top view of the practice mat originally introduced in FIG. 1, set up for a right hand golfer.

The following discussion will be with regard to the use of the practice mat 100 by a right hand golfer. However, it is understood, that the following discussion is equally applicable to the use of the practice mat 100 by a left-hand golfer. Referring now to FIG. 2, the golf ball 124 is illustrated positioned toward one end of the impact pad 120. The impact pad 120 generally includes a leading-edge 130, a trailing edge 132, a near side 134 and a far side 136. It should be noted that, while the impact pad 120 is illustrated as being rectangular, it may have other shapes including symmetrical shapes such as circular, oval, triangular, etc. or asymmetrical such as kidney shaped, etc.

Figure 3:
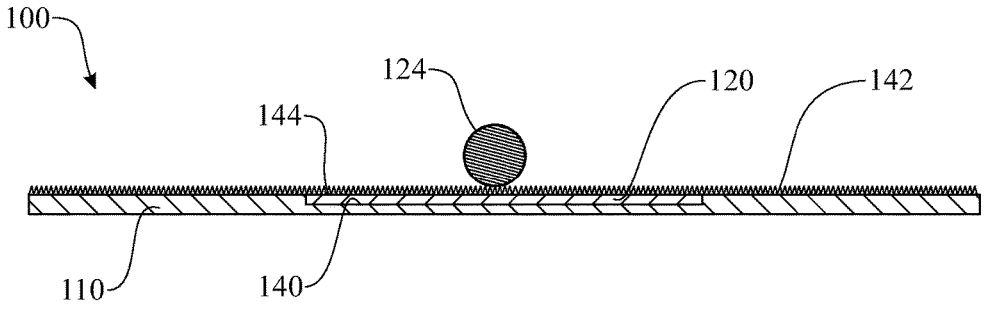
FIG. 3 presents a cross-sectional view taken along section line 3-3 of FIG. 2, illustrating the thermochromic and non-thermochromic artificial turf portions of the mat.

Referring now to FIG. 3, the impact pad 120 is illustrated as being positioned within a recess or depression 140 formed within the base 110 of the practice mat 100. In order to better represent actual golfing conditions, the base 110 is covered with a layer of artificial turf 142. Similarly, the impact pad 120 is also covered with a layer of artificial turf 144. As noted hereinabove, the impact pad 120 includes a reversible thermochromic leuco dye to temporarily show the actual line of swing of a golf club and the actual position and orientation of the golf club head or face at the moment of impact with the golf ball. Likewise, the artificial turf 144 may alternatively (or additionally) be provided impregnated with a reversible thermochromic leuco dye. Again, any known means of incorporating the reversible thermochromatic leuco dye into the impact pad 120 of the present invention may be used. In that regard, it is further contemplated as an alternative to impregnation, etc., to coat artificial turf strands, the surface of the impact pad, or both, with a reversible thermochromic leuco dye, to provide the beneficial resulting temporarily visible swing impact feedback.

It should be noted that base 110 and the artificial turf 142 may be constructed from a rubberized material, while the impact pad 120 and the artificial turf 144 may be formed from a rubber, fiber or polymeric material.

As already described clearly above, thermochromic leuco dyes are a group of materials which change color when subjected to changes in temperature. Significantly, in the present invention it is highly advantageous to incorporate a subset of such dyes which have "reversible" color characteristics. That is, the dyes only change from a first ambient temperature color toward clear for a brief period of time (e.g., a few seconds), thereafter automatically changing back to the original ambient temperature color. In this manner, the present invention is well-adapted for very efficient repeated use without requiring the user to wait too long for the mat swing markings to "disappear."

In the present invention, the amount of temperature change occurs as a result of heat caused by frictional contact across the surface of a substrate impregnated, coated or otherwise integrated, with a reversible thermochromic leuco dye. As is well known, myriad reversible thermochromic leuco dyes are known that can be incorporated into various base substrate materials, such as, for example, yarns, threads or other fabrics, polymers, etc.

The use of the practice mat 100 to assist a golfer in perfecting his golf swing by giving temporary visual feedback of the actual golf swing line will now be discussed. As best shown in FIGS. 1 and 3, the golf ball 124 is initially positioned upon the surface of the impact pad portion 120, preferably toward leading edge 130. Referring briefly to FIG. 1, the right-handed golf club 122 generally includes a golf club shaft 148 having a golf club head 150 and a golf club handle/grip 152.

With reference to FIGS. 1 and 2, a golfer (not shown) initially positions his feet, orients his body properly with respect to the ball position (which will depend upon the type of club being used), and grasp the golf club 122 by the golf club handle 152 (FIG. 1) in preparation for a golf swing. Upon executing the golf swing, the golfer swings the golf club 122 in the direction of arrow A to bring the golf club head 150, and more particularly, a face 154 of the golf club head 150 into contact with the golf ball 124. During a proper swing, the golf club head 150 will draft across a portion of the impact pad area.

Figure 4:
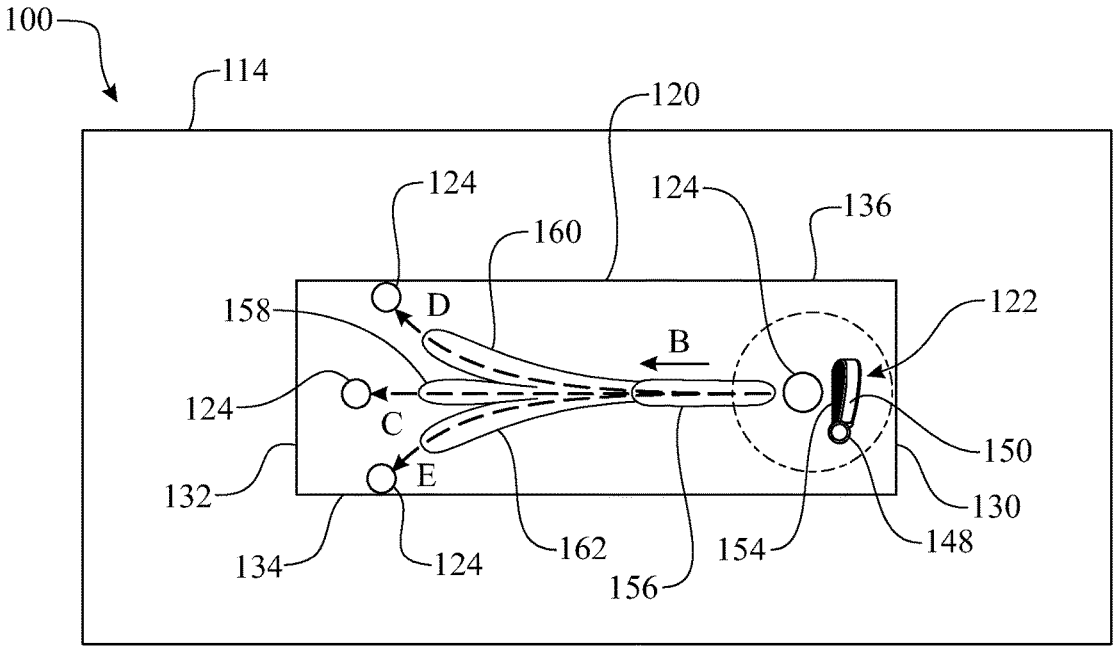
FIG. 4 presents a top view of the practice mat originally introduced in FIG. 1, illustrating the temporary visual paths of golf swings, shown in thermochromic center portion of the practice mat, after the golf balls have been hit straight, right and left across the center portion of the practice mat.

Referring now to FIG. 4, as the golf ball 124 is impacted by the face 154 of the golf club head 150, the golf ball 124 is driven from the leading edge 130 of the impact pad 120 and along the impact pad 120 in the direction of arrow B. As the golf ball 124 is driven over the impact pad 120 the golf club head generates frictional heat causing a color change in the thermochromic dye, as described above, in the impact pad 120 and/or the artificial turf 144 contacted. This causes a temporary visual indicator or trace of the path of the golf club along the impact pad 120. The initial path 124 leaves an initial, linear trace 156 on the impact pad 120 and aligned with the direction of arrow B. If the golfer's swing is true and straight, a continuing straight linear trace 158 appears across the impact pad 120 extending toward the trailing edge 132 of the impact pad 120. However, if the golfer strikes the golf ball 124, for example, in an inside-out non-linear path as depicted by "D" (e.g., a swing path that could typically result in a so-called ball "slice" (depicted by path "D"), the path of the golf club head across the impact pad will appear as a slice trace 160 arcing away from the golfer and toward the far side 136 of the impact pad 120. Likewise, if the golfer drives the golf ball 124, for example, in an outside-in non-linear path as depicted by "E" (e.g., a swing path that could typically result in a so-called "hook" (depicted by path "E"), the path of the golf club head across the impact pad will appear as a hook trace 162 arcing toward the near side 134 of the impact pad 120.

In this manner, the practice mat 100, incorporating a thermochromic dye into the impact pad 120, provides an immediate visual feedback to the golfer of the line of his swing and greatly aids in analyzing his golf swing.

Figure 5:
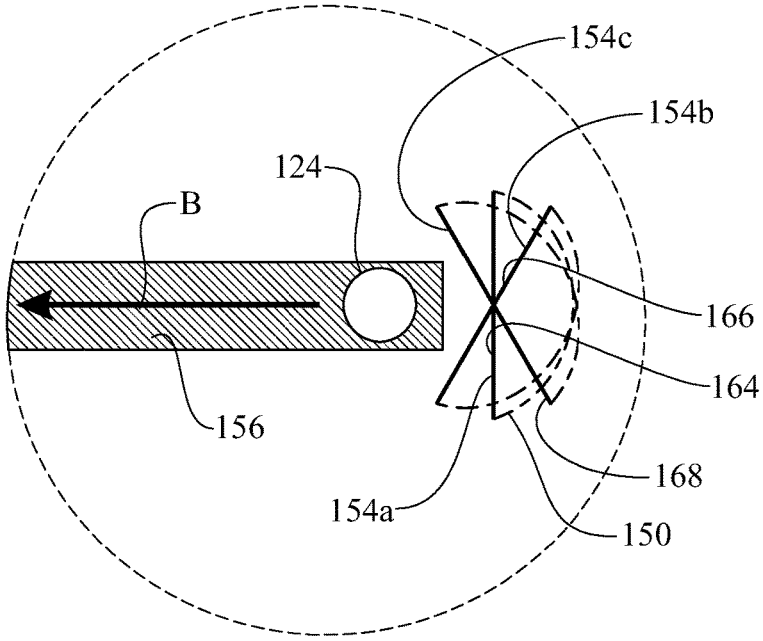
FIG. 5 presents an enlarged area of detail view of FIG. 4, illustrating the visual impression made in the thermochromic center portion of the practice mat by initial impact of a club face including the initial angle of contact of the club face perpendicular to the line of the swing, angled right and left of the line of the swing, within the thermochromic center portion.

Referring briefly to FIG. 5, additionally, as the face 154 of the golf club head 150 impacts the impact pad 120, the frictional impact heats the thermochromic dye and leaves an initial impact mark or impression in the impact pad 120. For example, if the golf club head 150, and thus the golf club face 154, is perpendicular to the intended line of the golf swing, the perpendicularly aligned golf club face 154*a* leaves a straight impact impression 164 in the impact pad 120. Alternatively, if the golfer "slices" the golf shot, the angled golf club face 154*b* leaves a slice impact impression 166 in the impact pad 120. Similarly, if the golfer "hooks" the golf shot, the alternative angled golf club face 154*c* leaves a hook impact impression 168 in the impact pad 120. Thus, in addition to seeing the traces of the actual golf swing, the golfer can look down and see exactly how the golf face 154 of the golf club head 150 was aligned relative to the line of the golf swing at the initial impact with the golf ball 124 to better analyze his golf swing.

Figure 10:
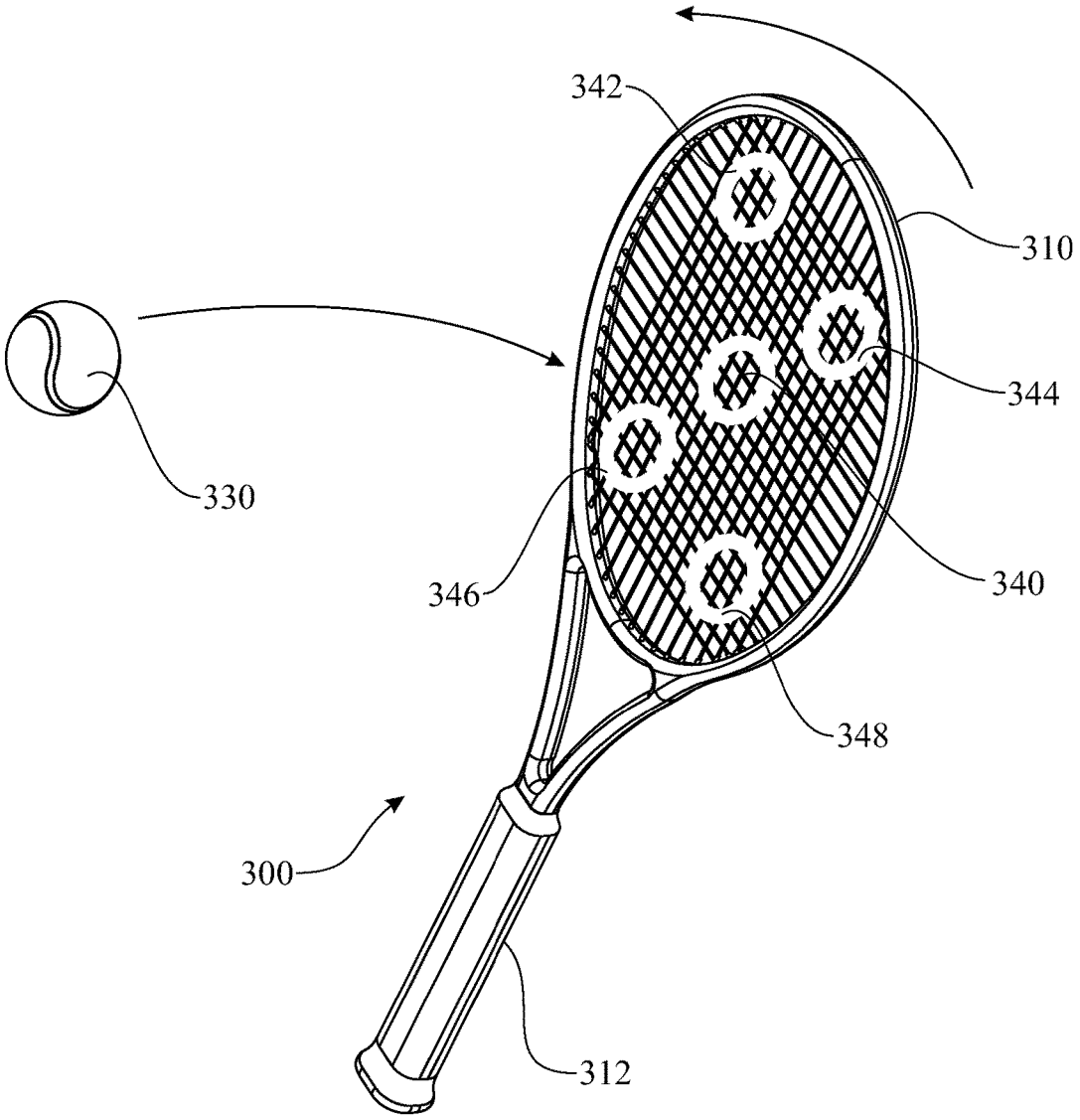
FIG. 10 presents an isometric view of the tennis racquet, originally introduced in FIG. 8, illustrating temporary visual impressions of impacts with a tennis ball visible on the strings having the thermochromic coating or dye.
Figure 11:
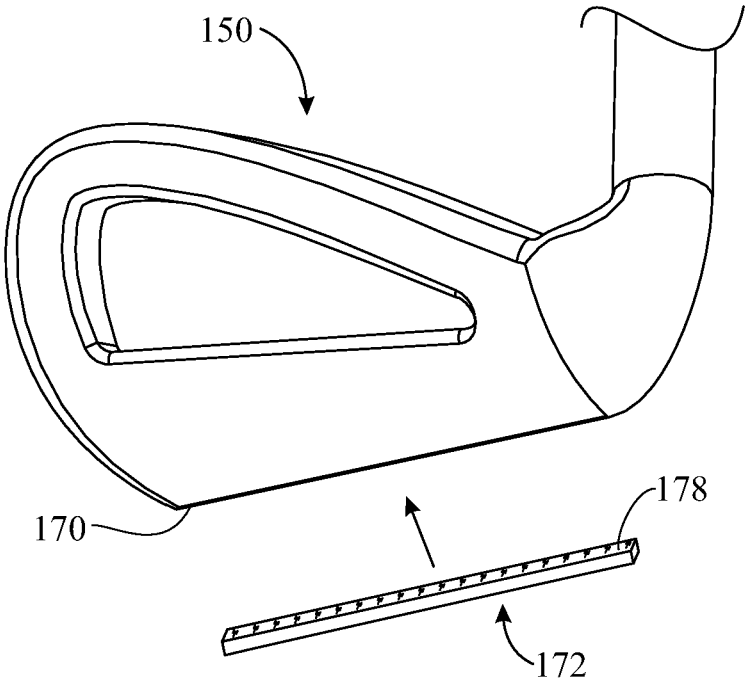
FIG. 11 presents a rear elevation view of an exemplary golf club head/blade, illustrating the preferred adhesive attachment of a resilient strip (following removal of an adhesive backing) upon a bottom surface of the club head/blade.
Figure 12:
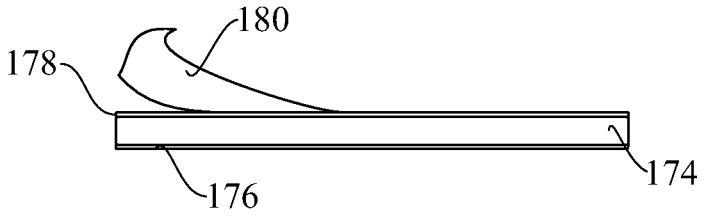
FIG. 12 presents a front elevation view toward a lateral edge of the resilient strip (prior to complete removal of the adhesive backing)
Figure 13:
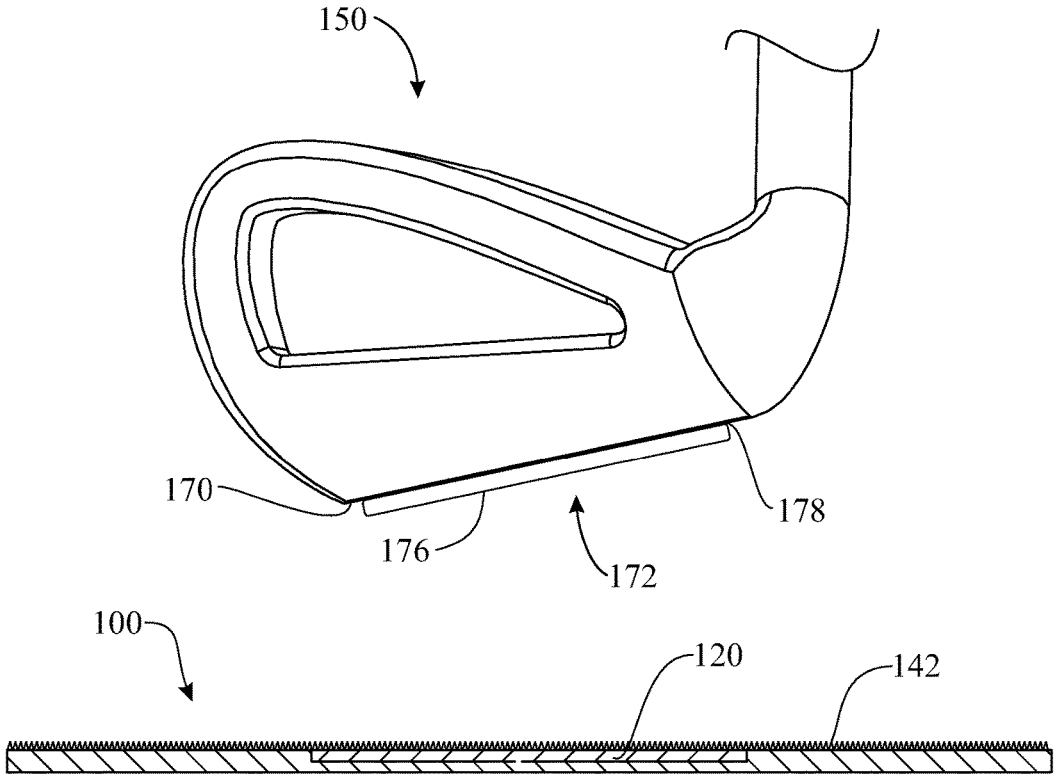
FIG. 13 presents a rear elevation view of the exemplary golf club head/blade in FIG. 11, following adhesive attachment of the resilient strip to the bottom surface of the club head/blade (shown positioned above the practice mat of the present invention).

Referring briefly to FIGS. 11 through 13, through extensive experimentation, the present inventors have discovered that the efficacy of the present invention is significantly improved, and otherwise enhanced, through the addition of a relatively thin strip of a resilient substrate, shown generally as reference numeral 172 (FIG. 10), attached to a lower surface 170, or bottom surface, of the golf club head/blade 150. The present inventors have discovered that when the textured lower surface 176 of a resilient base substrate 174 of the resilient strip 172 contacts the upper surface 142 of the impact pad portion 120 of the practice mat 100 (FIG. 1-5), there is an increased friction between the textured surface 176 of the resilient strip base substrate attached to the club head/blade 150, and upper surface 142 of the impact pad portion 120, which significantly enhances the temperature increase of the reversible thermochromic leuco dye, thereby enhancing the depth of the color change, the visibility of the temporarily visible swing path marking, and the length of time that the temporary swing path marking is visible.

Preferably, when used in connection with the golf club swing implementation of the invention, the textured resilient strip 172, constructed from, for example, silicone, neoprene or any other similar rubber-like material, is provided having a length within a range of approximately two (2) to four (4) inches, and a width in a range of approximately one-half (½) to three-quarters (¾) of one inch. The resilient base substrate 174, preferably in the form of a relatively thin adhesive tape, includes an adhesive layer 178 disposed on an upper surface opposite the textured lower surface 176. A removable protective adhesive backing 180 is easily peeled off to expose the adhesive layer 178 for temporary attachment to the lower club head/blade surface 170. Preferably, the strip composition incorporates an ultraviolet (UV) protecting component, in order to reduce degradation of the substrate from exposure to sunlight.

Figure 6:
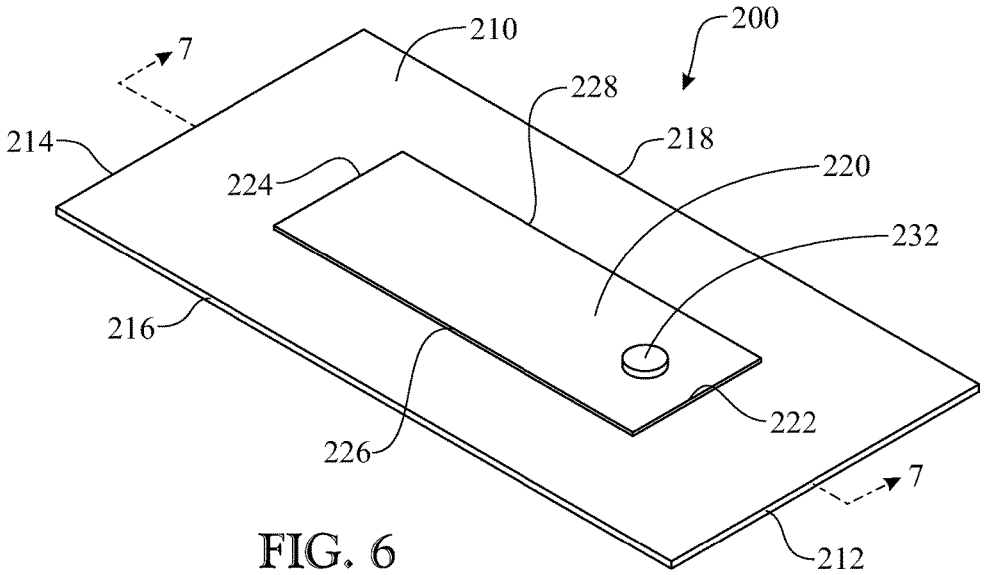
FIG. 6 presents an alternative embodiment of a practice mat, having a thermochromic material applied as a layer over the center portion of the practice mat, for use with a hockey puck and stick.
Figure 7:
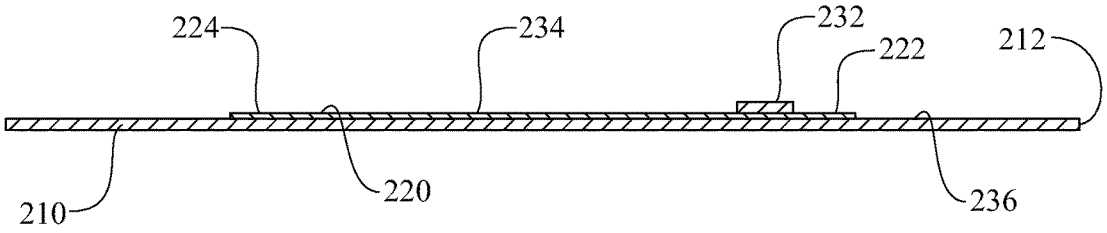
FIG. 7 presents a cross-sectional view taken along section line 7-7 of FIG. 6.

Referring now to FIGS. 6 and 7, there is disclosed an alternative practice mat 200 for use in perfecting and analyzing the swing of an ice hockey player. The practice mat 200 is similar to practice mat 100 described hereinabove, and generally includes a base 210 having a first end 212, a second end 214, a first side 216 and a second side 218. The practice mat 200 additionally includes an impact pad 220 having a leading edge 222, a trailing edge 224, a near side 226 and a far side 228.

In contrast to the impact pad 120 above, where the impact pad 120 is a separate structure from the base 110 and the thermochromic dye is incorporated directly into the material or fibers forming the impact pad 120 and/or the artificial turf 144, in this embodiment, the impact pad 220 is formed on the base 210 by applying a thin layer 234 of thermochromic dye directly onto an upper surface 236 of the base 210.

In use, the hockey player approaches the practice mat 200 in the manner similar to that described above for a golfer and swings a hockey stick (not shown) to impact the hockey puck 232 and drive it along the impact pad 220 from the leading edge 222 of the impact pad 220 toward a target (not shown). The frictional heat caused by the hockey puck 232 moving over the impact pad 220 causes the thermochromic dye forming the impact pad 220 to temporarily change color and, similar to the traces above, leave temporary traces on the surface of the impact pad 220 to show the hockey player if his shot went straight, away toward the second side 218 of the base or toward the first side 216 of the base. While not specifically shown, the initial impact of a blade of the hockey stick will leave straight or angled impact impressions on the impact pad 220 similar to the impact impressions described herein above with regard to the face 154 of the golf club head 150. This will aid the hockey player in further analyzing his swing.

As will be apparent to those skilled in the art, a resilient rubber strip, similar to that shown and described with reference to the golf swing analysis implementation of the present invention, is contemplated for use with the hockey stick blade striking implementation of the invention. Obviously, the geometry, thickness, etc., would be varied in light of the different configuration of the blade end of a hockey stick.

Figure 8:
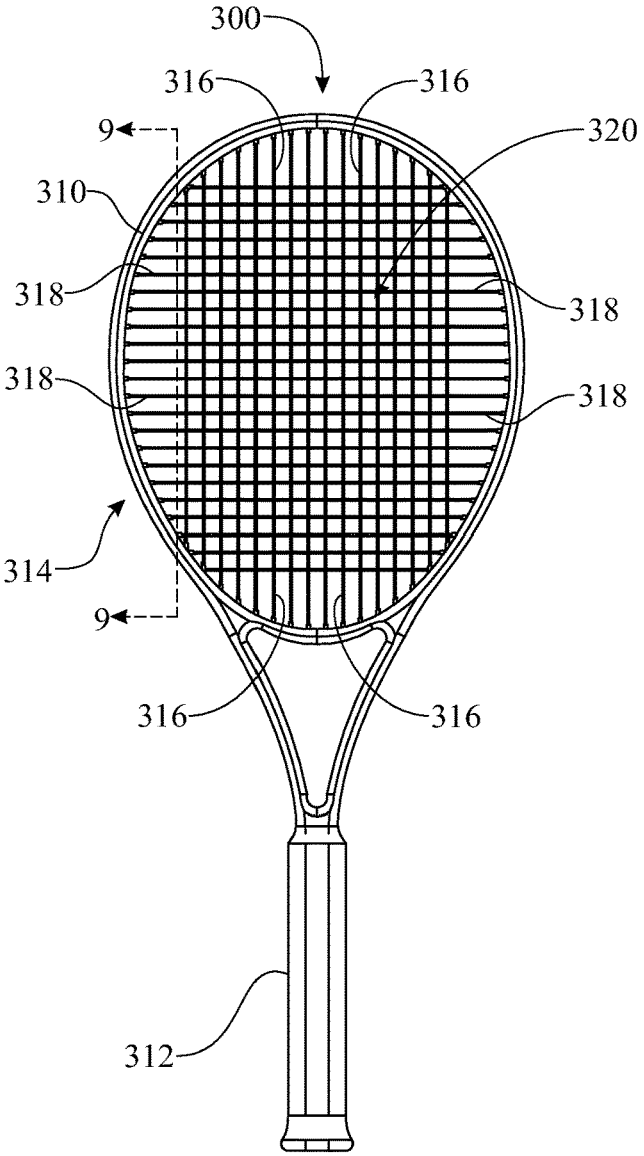
FIG. 8 presents a front elevation view of a tennis racquet incorporating a thermochromic material in the form of a thermochromic dye or coating into a portion of the strings of the tennis racquet.
Figure 9:
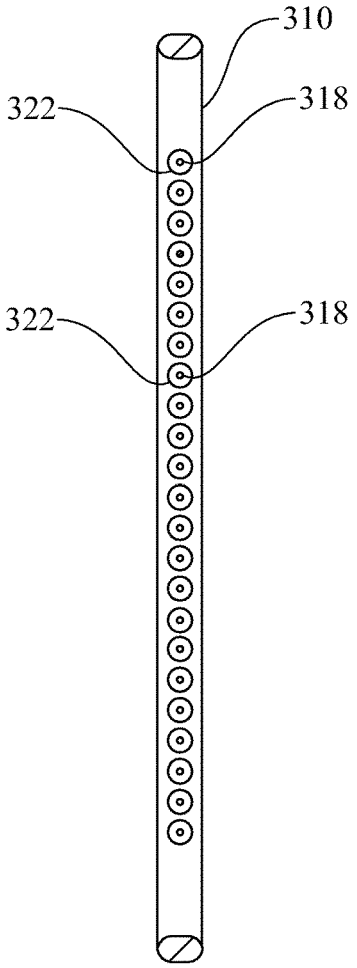
FIG. 9 presents a cross-sectional view taken along section line 9-9 of FIG. 8, illustrating a thermochromic coating on the strings of the tennis racquet.

Turning now to FIGS. 8-10, the uses of a thermochromic dye to assist a player analyze their swing also finds applicability when applied directly to the hitting implement. In this embodiment a tennis racquet 300 generally includes an oval frame 310 having a handle 312 and a string assembly 314 stretched within the oval frame 310. The string assembly 314 consists of a series of vertical strings 316 interspersed with a series of horizontal strings 318 as commonly known in the construction of tennis racquets generally. The resultant overlapping or intersecting area of the vertical strings 316 with the horizontal strings 318 forms an impact area or zone 320.

In this embodiment, the impact zone 320 of the vertical and horizontal strings 316 and 318, respectively, are preferably impregnated with a reversible thermochromic leuco dye which changes color upon impact and frictional contact with a tennis ball as described in more detail hereinbelow. Alternatively, the vertical and horizontal strings 316 and 318 individual fibers may be infused with a thermochromic leuco dye during production and prior to being incorporated into the tennis racquet 300.

Referring specifically to FIG. 9, the horizontal strings 318 are illustrated coated with a thermochromic leuco dye 322. While not specifically shown, the vertical strings 316 are similarly coated with the thermochromic leuco dye 322. As noted above, the thermochromic leuco dye 322 temporarily changes color upon change in temperature. Thus, upon impact by a tennis ball, the friction created by the impact cause a temperature rise resulting in a color change on the impacted area of the impact area zone 320.

Referring now to FIG. 10, in use, the tennis racquet 200 is grasped by the handle 312 by a tennis player and a tennis ball 330 is thrown or shot by a machine toward the tennis player. The tennis player swings the tennis racquet 300 and hits the tennis ball 330 with the string assembly 314 of the tennis racquet 300. As the tennis ball 330 impacts an area of the impact zone 320, the frictional contact raises the string temperature causing the thermochromic dye at that location to change color and leave a temporary visual indication of the area of the hit. For example, if the player hits the tennis ball 330 with the center of the impact zone 320 a central impression 340 will be temporarily visible confirming a good, solid swing and hit.

However, if the hit tennis ball 330 flies away from the tennis racquet 300 in a direction other than what the tennis player intended, the player need merely look at the impact zone 320 on the string assembly 314 to see where the tennis ball impacted. For example, the tennis ball 320 may have impacted high and away from the center of the impact zone 320 leaving a high and away impression 342 on the string assembly 314 within the impact zone 320. Other off center hit may be visually indicated by respective high and near impression 344, low and away impression 346 or low and near impression 348 or any other impressions revealed by the thermochromic leuco dye. Thus, the incorporation of a reversible thermochromic leuco dye into the impact zone 320 of the string assembly 314 of the tennis racquet 300 provides an instant and simple method for a tennis player to evaluate and analyze where on the tennis racquet 300 he is hitting the tennis ball 330 and the nature and quality of his tennis swing.

It should be noted that the incorporation of a reversible thermochromic dyes into other sporting implements for the purpose of analyzing a swing are also contemplated such as, for example, a thermochromic dye coating on a base ball bat, a table tennis paddle surface, etc.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A golf club swing practice aid system for providing visible feedback relating to characteristics of a user's swing of a golf club while attempting to strike a golf ball or attempting to strike a user-visualized imaginary golf ball with a golf ball contact end of the golf club, the practice aid system comprising:

a strip of resilient substrate, the resilient substrate strip in the form of a thin planar adhesive tape having a first exposed textured surface, an opposite second substrate surface having an adhesive layer disposed thereon, wherein said resilient substrate strip is configured and otherwise sized and shaped for being adhesively secured to a bottom surface of said golf ball contact end of said golf club;

an impact pad having a topside constructed and configured for supporting the golf ball or user-visualized imaginary golf ball intended to be struck by said golf ball contact end while swinging said golf club; and a reversible thermochromic leuco dye integrated into a surface area of said impact pad topside along which frictional contact is made between said surface area of said impact pad topside and said exposed textured surface of said thin planar adhesive tape when said user swings said golf club such that said exposed textured surface of said resilient substrate strip makes frictional contact with said surface area of said impact pad, said reversible thermochromic leuco dye having the characteristic of temporarily displaying a visibly noticeable color change resulting from an increase in temperature generated from said frictional contact, wherein, during the process of swinging said golf club and striking said impact pad with said exposed textured surface of said resilient substrate strip, said frictional contact is increased by the presence, as compared to the absence, of contact of said exposed textured surface of said resilient substrate strip with said impact pad topside surface area and thereby the temperature increase of said thermochromic leuco dye is enhanced such that a resulting enhanced depth of color change along said entire contact surface area of said impact pad topside is produced that increases the visibility of a temporarily visible contact path made in said reversible thermochromic leuco dye on said impact pad topside during said swing.

2. The sports golf club swing practice aid system as recited in claim 1, further comprising a base constructed and configured for being positioned upon a ground surface for preventing movement of said impact pad during contact between said exposed textured surface of said resilient substrate strip on said golf club golf ball contact end and said impact pad, wherein said impact pad is removably supported by said base.

3. The sports practice aid system as recited in claim 2, wherein the surface area of said topside of said impact pad occupies about one-quarter to one-half of an area of said base.

4. The golf club swing practice aid system as recited in claim 2, wherein said base and said impact pad are generally rectangular.

5. The golf club swing practice aid system as recited in claim 2 wherein said base further comprises a cavity for receiving said impact pad provided in an upper surface of said base, said cavity conforming to the perimeter of said impact pad.

6. The golf club swing practice aid system as recited in claim 1, said impact pad further comprising a layer of artificial turf integrated into said topside of said impact pad with artificial turf strands extending upward therefrom.

7. The golf club swing practice aid system as recited in claim 6, wherein said reversible thermochromatic leuco dye is impregnated into said artificial turf layer.

8. The golf club swing practice aid system as recited in claim 6, wherein said reversible thermochromatic leuco dye is also impregnated into said artificial turf strands.

9. The golf club swing practice aid system as recited in claim 6, wherein said artificial turf strands are coated with said reversible thermochromatic leuco dye.

10. The golf club swing practice aid system as recited in claim 1, wherein said resilient substrate strip further comprises a layer of removable adhesive backing material removably attached to said adhesive layer of said resilient substrate strip for protecting said adhesive layer prior to removal of said removable adhesive backing material layer for subsequent attachment of said resilient substrate strip to said bottom surface of said golf club golf ball contact end.

11. The golf club swing practice aid system as recited in claim 1, wherein said resilient substrate strip has a length within a range of approximately two inches to four inches.

12. The golf club swing practice aid system as recited in claim 1, wherein said resilient substrate strip has a width within a range of one-half to three-quarters of an inch.

13. The golf club swing practice aid system as recited in claim 1, wherein said resilient substrate strip includes an ultraviolet protecting component for minimizing degradation of said resilient substrate strip from exposure to sunlight.

* * * * *